US005307754A

United States Patent [19]

Leonardis

[11] Patent Number: 5,307,754

[45] Date of Patent: May 3, 1994

[54] HYDROFOIL STABILIZER

[76] Inventor: Nicola Leonardis, 23 Mayfred Ave., Hope Valley, SA 5090, Australia

[21] Appl. No.: 869,795

[22] Filed: Apr. 16, 1992

[30] Foreign Application Priority Data

Apr. 19, 1991 [AU] Australia ..... PK5875

[51] Int. Cl.[5] ..... B63B 21/26

[52] U.S. Cl. ..... 114/274; 440/900

[58] Field of Search ..... 114/274, 280–282; 440/900, 66, 71, 51

[56] References Cited

U.S. PATENT DOCUMENTS

| | | | |
|---|---|---|---|
| 2,917,016 | 12/1959 | Schertel | 114/274 |
| 3,955,527 | 5/1976 | Holtermann . | |
| 3,991,700 | 11/1976 | Cleary et al. | 440/51 |
| 4,088,091 | 5/1978 | Smith . | |
| 4,205,618 | 6/1980 | Olsson | 114/281 |
| 4,487,152 | 12/1984 | Larson . | |
| 4,708,672 | 11/1987 | Bentz et al. . | |
| 4,744,779 | 5/1988 | Koehler | 440/66 |
| 4,968,275 | 11/1990 | Carlson . | |
| 4,977,847 | 12/1990 | Bartlett | 440/900 |
| 4,995,840 | 2/1991 | Seale et al. | 440/66 |
| 5,138,966 | 8/1992 | Whitley, II | 114/274 |

FOREIGN PATENT DOCUMENTS

| | | |
|---|---|---|
| B 48552 | 4/1987 | Australia . |
| 199297 | 11/1985 | New Zealand . |

*Primary Examiner*—Edwin L. Swinehart
*Attorney, Agent, or Firm*—Kinzer, Plyer, Dorn, McEachran & Jambor

[57] ABSTRACT

A hydrofoil stabilizer for a marine craft employing an outboard or inboard/outboard motor. The stabilizer is specially shaped to have a central position adapted to attach to an existing cavitation plate of the motor, two upwardly sloping portions the angles of which approximate the bottom of the marine craft, and two peripheral portions adapted to improve the stability of the craft by running in relatively less turbulent water away from the immediate vicinity of the propellor. The stabilizer improves the turning and tracking characteristics of the craft.

11 Claims, 4 Drawing Sheets

HYDROFOIL STABILIZER

This invention relates to marine craft employing outboard or inboard/outboard motors and in particular to improvements for motors having a cavitation plate.

Most inboard/outboard motors and outboard motors with propellers have a cavitation plate affixed to an outboard part of the motor above a propeller. A purpose of this plate is to reduce cavitation. It is conventional to provide a plate for this purpose that is essentially flat across its lowermost working face.

I have found that significant improvements in the performance of a boat being driven by such an arrangement can be achieved by changing the shape and relative position of a cavitation plate from that which has hitherto been used.

It is also known to provide trim tabs which provide lift at the stern to assist the craft to move onto the plane and to improve stability in rough seas. Although trim tabs work well they have a high drag coefficient which detracts from the maximum performance of the craft.

The basis of this invention is the discovery that the cavitation plate can be changed in shape and position, so that in a forwardly driven boat this will give a reduced drag coefficient and can provide for improved handling and turning characteristics.

The reason for this appears to be that the bottom of the craft displaces water in a way which forms a wake, the upper surface of which has a profile substantially matching that of the craft. A normal extended cavitation plate cuts through this wake, particularly at the sides, and therefore creates drag. According to this invention a plate is specially shaped to reduce drag and yet provide improved handling, tracking and turning characteristics. This is done by providing a plate which is shaped and positioned to skim the water in the wake of the craft when the craft is running.

It is an object of this invention to provide a stabilizer plate, for a marine craft employing a motor with an outboard leg, which improves the performance characteristics of the craft while minimising drag.

This is achieved by shaping and positioning a stabilizer device such that a substantial portion of the device has a lower surface adapted to be located just in or skimming the surface of the water in the wake produced by the craft rather than cutting through it as in the normal case. The device is adapted to provide a lifting moment at the stern of the craft while the craft is moving in a forward direction.

There are provided peripheral portions which engage relatively less turbulent water away from the propeller to improve tracking performance of the craft. In addition these peripheral portions enhance the turning capabilities of the craft by resisting yawing of the craft during turns. In effect the craft will turn flatter and tighter due to the peripheral portion on the inside of the turn acting as a pivot point.

Therefore, according to perhaps one form of this invention, although this need not be the only or indeed the broadest form, there is proposed a stabilizer plate for a marine craft employing a motor with an outboard leg in which there is provided:

a central portion with an attachment means to attach to an existing cavitation plate on the motor;

two upwardly sloping portions, one either side of the central portion, having an outer edge and an inner edge nearer the central portion; and two peripheral portions, one per upwardly sloping portion, attached to the outer edges of the upwardly sloping portions.

In preference the central portion is as narrow as possible. In practice this means that it is only sufficiently wider than the existing cavitation plate to enable attachment of the stabilizer plate to the cavitation plate.

The central portion of the plate captures water that is thrown up by the propeller and provides additional thrust as with conventional plates. The central portion is kept as narrow as practical to minimise the drag generated by the plate cutting into the wake.

The central portion may also be provided with a fin positioned on a central axis of the plate and sufficiently towards the rear of the plate to avoid fouling the propeller. The fin further improves the tracking of the craft, particularly in broken or rough water. In preference the fin is detachable, there being provided a plurality of holes in the central portion of the plate. The fin is formed with an upper plate portion which has matching holes through which the fin is bolted or riveted to the plate. Alternatively, the fin can be welded in place or integrally formed with the plate.

In one form the attachment means consists of a slot and fixing means, the slot being adapted to fit over a stem of the outboard leg, and the fixing means being adapted to affix the stabilizer plate to the existing cavitation plate. The fixing means may consist simply of bolts which pass through both plates to hold them together.

Alternatively the fixing means may consist of two or more clamping plates, with the existing cavitation plate clamped between the clamping plates and the central portion. In preference the clamping plates and the central portion are recessed to accept the existing cavitation plate. The clamping plates can be affixed to the central portion using bolts so that the stabilizer can be easily removed. In this way there is no need to provide holes in the stern drive to hold the stabilizer plate. Alternatively rivets can be used instead of bolts, the advantage with rivets is that they have a lower profile than bolts and therefore provide less drag.

In a further arrangement the means of attachment consists of a slot, a plurality of elongate holes and two or more clamping plates with holes. The existing cavitation plate is clamped between the central portion and the clamping plates. In this form only the clamping plates are recessed to fit over the existing cavitation plate. The purpose of the elongate holes is to allow for lateral adjustment of the clamping plates to permit positioning flush against the cavitation plate.

In a still further arrangement the stabilizer plate may be formed as an integral part of the outboard leg in place of a conventional cavitation plate.

Some larger craft utilize an outboard leg that is fitted with two cavitation plates, one above the other. It is often the case with these motors that the lower plate actually tracks in the water. In this case the stabilizer plate is attached to the upper cavitation plate, however the choice is determined by the performance characteristics of the craft.

In preference the angle of the upwardly sloping portions approximates the angle of the bottom of the marine craft. In this way the upwardly sloping portions skim the wake of the craft when running and therefore minimize the amount of drag. However, by skimming the wake the portions provide a hydrofoil effect which generates lift to raise the stern and lower the bow therefore bringing the craft onto the plane earlier than would otherwise be the case.

In preference the angle of the peripheral portions is approximately parallel to a plane containing the central portion or angled downward. The purpose of the peripheral portions is to improve the stability of the craft when in motion and in particular to enhance turning capability and improve tracking in rough water. The peripheral portions also prevent pluming of water off the upwardly sloping portions and provide additional thrust by catching this water in the same way as the central portion.

The angle of the peripheral portions may be between 0 degrees and 45 degrees, and more usually between 0 degrees and 20 degrees, below a plane parallel to a plane containing the central portion. In one form of the invention the angle is adjustable. This versatility allows the stabilizer plate to be fine tuned for a particular marine craft.

Because the peripheral portions are positioned away from the immediate vicinity of the propeller the water in which they run is relatively clean. That is to say there is not as much turbulence as in the vicinity of the propeller. The effectiveness of the peripheral portions is therefore enhanced.

The turning capabilities of the craft are particularly improved by the peripheral portions. They act to prevent yaw, which normally accompanies a turning craft, by providing a resistance to rotation about a vertical axis of the craft. In particular they counteract the rotational torque generated by the motor when the craft is turned.

In preference the central portion, the two upwardly sloping portions and the two peripheral portions are formed as a single piece. In a further form the two peripheral pieces are detachable and are held in position by fixing means such as bolts, rivets or engaging slots. An advantage of having the peripheral portions detachable is that the performance of the craft can be fine tuned by careful selection of the angle of these portions relative to the rest of the stabilizer.

In an alternative form the stabilizer plate may be made in a plurality of parts such as a right and a left half.

In preference the stabilizer is formed from an appropriate metal. The metal should be chosen to minimise corrosion, suitable metals are stainless steel or marine grade aluminium. The plate could be cast or pressed.

In a further form the stabilizer plate can be formed from resilient plastics material. The advantage of plastics material is that it does not adversely effect the corrosion protection of the motor. A suitable plastics material would be glass fibre reinforced nylon.

Of course it will be realised that a wide range of materials are suitable for forming a stabilizer plate and the above discussion should not be taken to exclude fibreglass, carbon fibre or any other materials. Furthermore, there are a variety of production techniques possible and the above should only be taken as examples.

In a yet further alternate form of the invention a series of ribs are formed on the underside of the stabilizer plate. The ribs are formed to run from the front to the back of the plate in a similar way to the ribs provided on the underside of many marine craft. The inventor has found that ribs are not essential to the improved performance provided by the stabilizer plate but, in some instances, may provide additional enhanced performance.

The stabilizer plate improves all aspects of the performance of a marine craft employing an outboard leg. The craft achieves planing at a lower speed, the bow does not ride high in the water as the craft approaches the plane and speeds can be achieved at lower engine revolutions per minute than without the plate which results in reduced fuel consumption. The craft turns in a tighter radius and at slow speeds turns with less yaw. Less water spray from the motor is produced resulting in a flatter wash, which is an advantage for water ski craft.

To aid in the understanding of the invention an embodiment will be described with reference to drawings in which.

Figure 1:
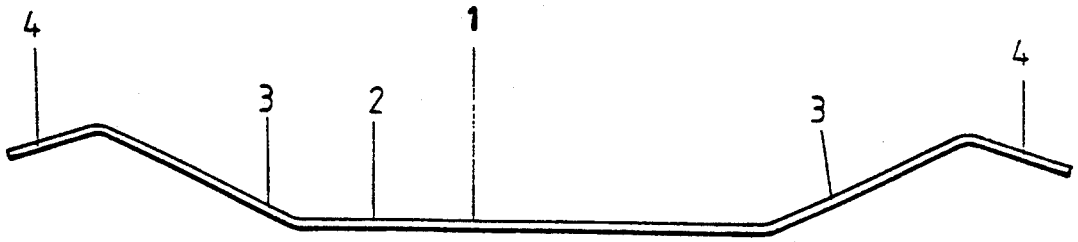
FIG. 1 shows a profile of a stabilizer plate.
Figure 2:
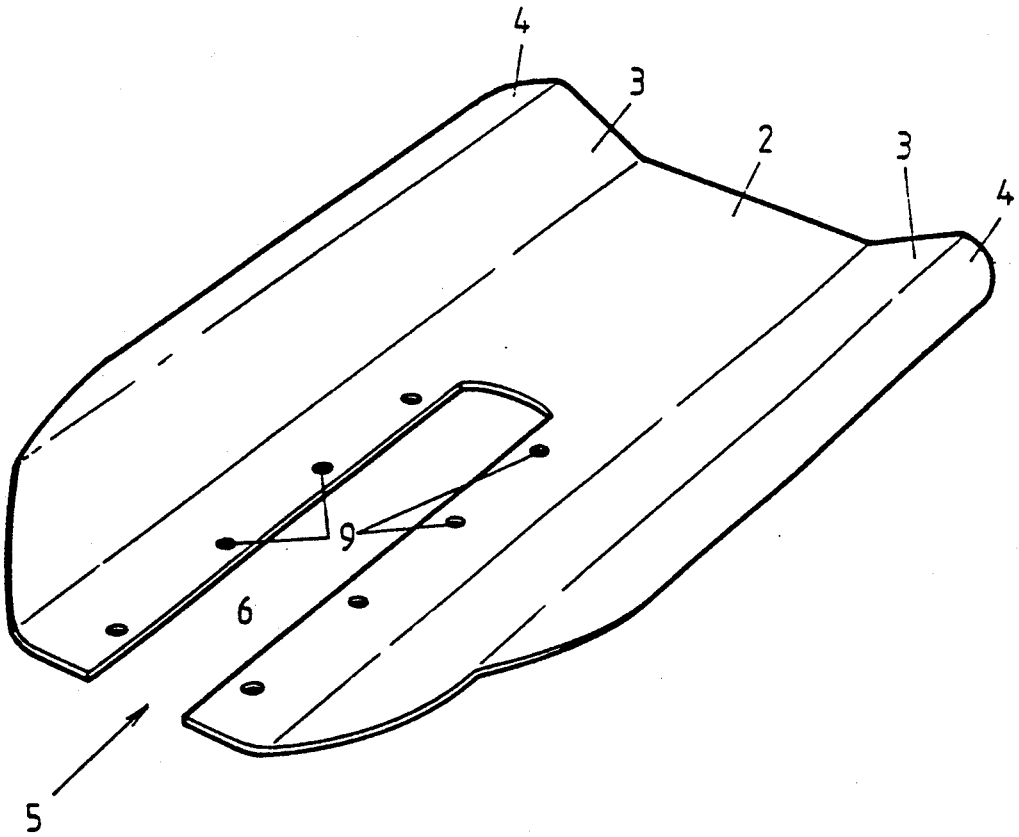
FIG. 2 is a sketch of a stabilizer plate.
Figure 3:
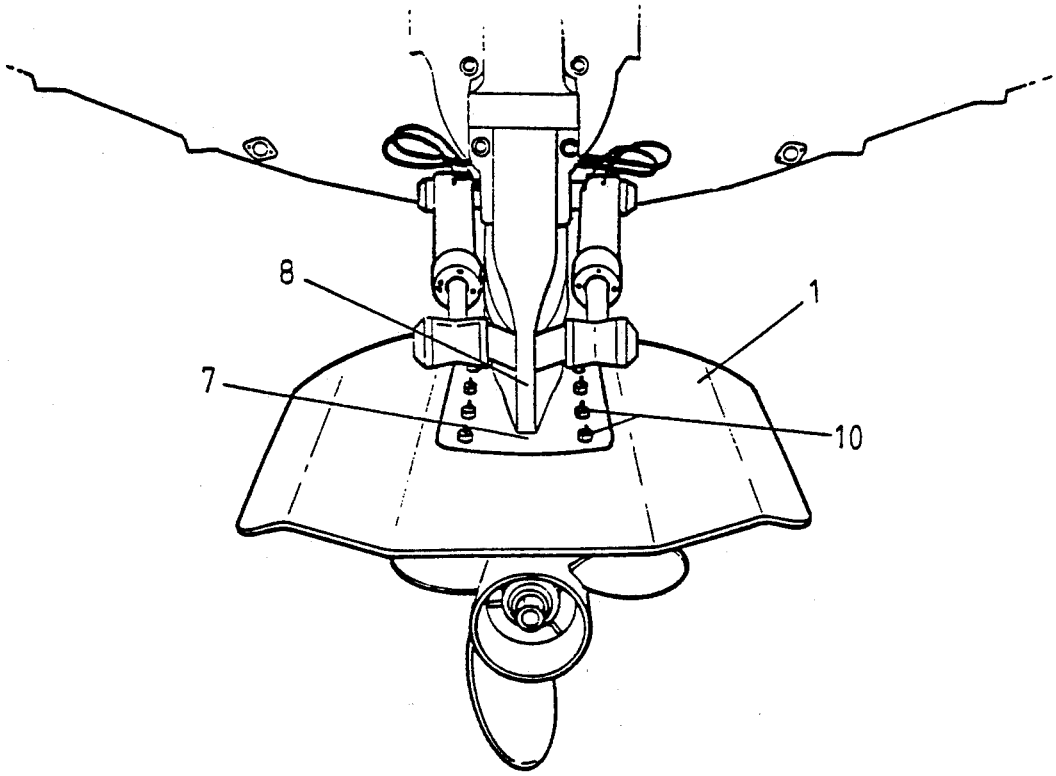
FIG. 3 shows a stabilizer plate attached to an outboard leg of a marine craft.

Referring now to the drawings in detail, there is shown a stabilizer plate 1 comprised of a central portion 2, two upwardly sloping portions 3 and two peripheral portions 4. The central portion 2 has a means of attachment 5 consisting of a slot 6 and holes 9 by which the plate 1 is attached to the cavitation plate 7 of an outboard leg 8. Bolts 10 are passed through the holes 9 to affix the stabilizer plate 1 to the existing cavitation plate 7. It is necessary to provide corresponding holes in the existing cavitation plate.

In the drawings the stabilizer plate is shown as being affixed beneath the existing cavitation plate. It could equally as well be positioned above the cavitation plate, however there are some advantages with respect to drag in positioning it below.

The stabilizer plate extends rearward from the craft at least beyond the extent of the propeller and it extends approximately the diameter of the propeller beyond the propeller. Furthermore the plate is at least wider than the extent of the width of the propeller and extends forward of the propeller approximately to the centre of the outboard leg. The stabilizer plate is tapered towards the forward end.

Figure 5:
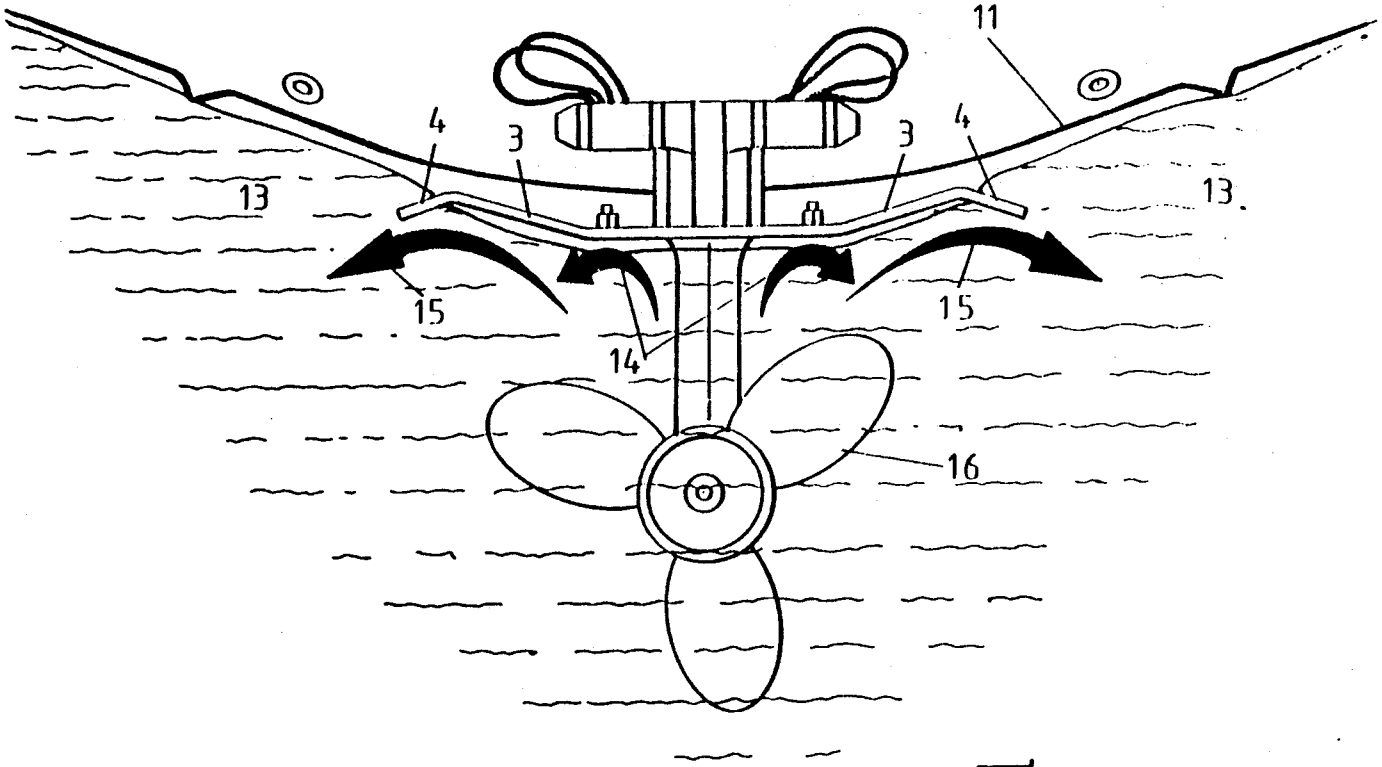
FIG. 5 shows the effect of a stabilizer plate on the wake of a marine craft.

In FIG. 5 the way in which the profile of the stabilizer plate 1 is shaped to approximate the shape of the hull 11 of a craft 12 can be seen. The craft produces a wake 13 which is similar to the shape of the hull 11. The upwardly sloping portions 3 follow the profile of the wake 13 and provide lift at the stern of the craft. The peripheral portions 4 cut the wake 13 in relatively clean water and provide added stability for turning.

The arrows 14 and 15 indicate the effect on the flow of water in the vicinity of the propeller 16. In the absence of the stabilizer plate energy is lost through the propeller 16 throwing up water. With the plate, the water is trapped as shown by the arrows 14 and harnessed to provide additional thrust, thus improving craft performance. The peripheral portions act to reduce spray, add thrust and improve tracking by deflecting the water as shown by arrows 15.

Figure 6:
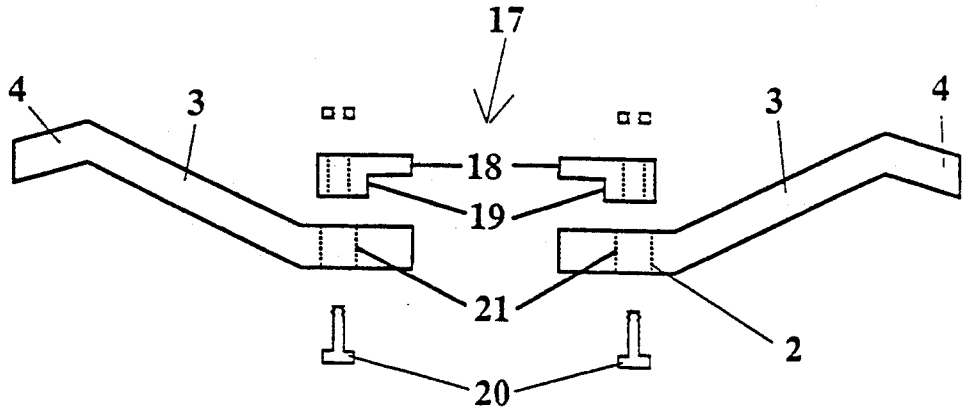
FIG. 6 shows a schematic of an alternative attachment means.

An alternative attachment means 17, as shown in FIG. 6, consists of two clamping plates 18 with recesses 19. The existing cavitation plate is clamped between the clamping plates 18 and the central portion 2 by bolts 20, in this way the stabilizer plate can be attached to the motor without leaving any damage. The bolt holes 21 in the central portion 2 are elongated to allow for adjustment of the clamping plates 18 to accommodate a variety of cavitation plate sizes.

Figure 4:
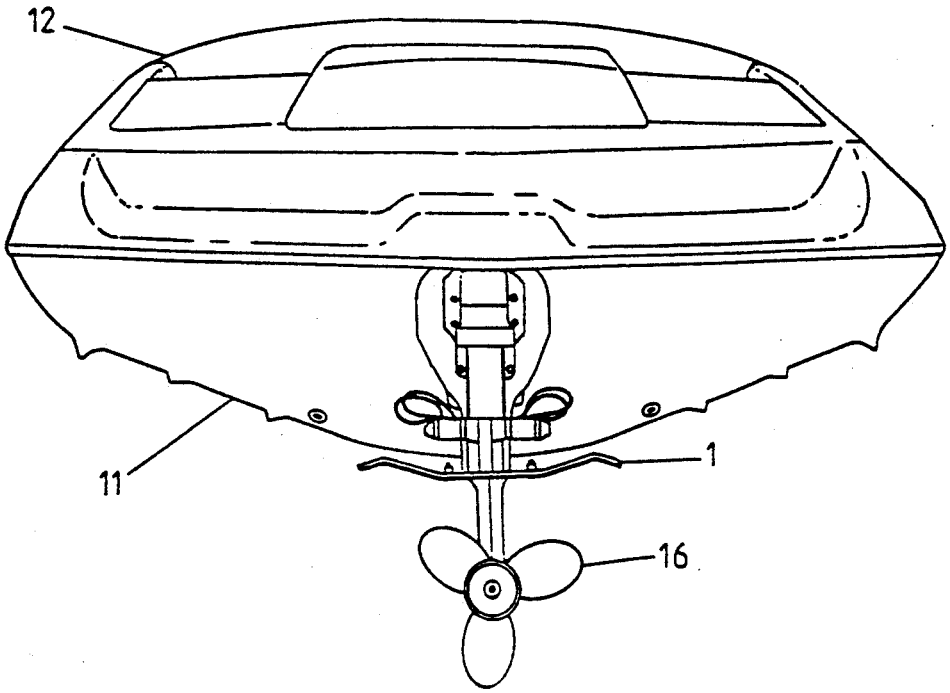
FIG. 4 shows a marine craft fitted with a stabilizer plate.

With the plate attached to a craft as shown in FIG. 4 and FIG. 5 the craft turned in less than half of the turning circle previously required. At low speeds the craft turned without yaw and within two boat lengths. The wake was flatter and less spray was produced. A speed for water skiing that was achieved at 3000 RPM was achieved at 2800 RPM with the plate.

Throughout this specification the purpose has been to illustrate the invention and not to limit this.

What is claimed is:

1. A stabilizer plate for a marine craft having a bottom disposed at least at one angle and employing a motor with an outboard leg including a propeller having a predetermined diameter and an existing cavitation plate connected thereto, the stabilizer plate comprising:

a substantially flat central portion including an attachment means to attach the central portion to the existing cavitation plate on the motor;

two substantially flat, longitudinally disposed upwardly sloping portions, one either side of the central portion, said central portion and said upwardly sloping portions extending rearwardly from the outboard leg beyond the extent of the propeller approximately the length of one diameter of said propeller beyond the propeller, each upwardly sloping portion having an inner edge nearer the central portion and an outer edge; and two peripheral portions, one for each upwardly sloping portion, attached to a respective outer edge of each of the upwardly sloping portions.

2. The stabilizer plate of claim 1 in which the central portion, upwardly sloping portions and peripheral portions are integrally formed together.

3. The stabilizer plate of claim 1 in which the central portion is of a width similar to that of the existing cavitation plate of the motor.

4. The stabilizer plate of claim 3 in which the attachment means consists of a slot and fixing means, the slot being adapted to fit over a stem of the outboard leg, and the fixing means being adapted to affix the stabilizer plate to the existing cavitation plate.

5. The stabilizer plate of claim 4 in which the fixing means consists of a plurality of elongate holes in the central portion and two or more clamping plates with holes adapted such that the existing cavitation plate is clamped between the clamping plates and the central portion by bolts passed through the said holes.

6. The stabilizer plate of claim 1 in which the angle of the upwardly sloping portions approximates the angle of the bottom of the marine craft.

7. The stabilizer plate of claim 1 wherein the central portion is substantially flat and in which the angle of the two peripheral portions is approximately parallel to a plane containing the central portion, the plane containing the central portion being coplanar with the flat plate.

8. The stabilizer plate of claim 1 in which the peripheral portions are angled downwards.

9. The stabilizer plate of claim 8 wherein the central portion is substantially flat and in which the angle of the peripheral portions is between 0 degrees and 45 degrees below a plane parallel to a plane containing the central portion.

10. A stabilizer plate for a marine craft having a bottom disposed at least at one angle and employing a motor having a propeller of a predetermined diameter and having an outboard leg and an existing cavitation plate connected thereto in which there is provided:

a substantially flat central portion including an attachment means to attach the central portion to the existing cavitation plate on the motor, said central portion being of a width similar to that of the existing cavitation plate and being shaped and dimensioned to capture water thrown up by the propeller;

two substantially flat, longitudinally disposed, upwardly sloping portions, one portion being disposed on either side of the central portion, said central portion and said upwardly sloping portions extending rearwardly from the outboard leg beyond the extent of the propeller approximately the length of one diameter of said propeller beyond the propeller, each upwardly sloping portion having an inner edge nearer the central portion and an outer edge, the angle of said upwardly sloping portions approximating the angle of the bottom of the marine craft and being shaped and dimensioned to skim the wake of the craft when running; and two peripheral portions, one for each upwardly sloping portion, attached to a respective outer edge of each of the upwardly sloping portions, the angle of the peripheral portions being between 0 degrees and 45 degrees below a plane parallel to a plane containing the central portion, and said peripheral portions being shaped and dimensioned to run in a relatively less turbulent water away from the immediate vicinity of a propeller.

11. A marine craft having a bottom disposed at least at one angle and employing a motor having a propeller of a predetermined diameter and having an outboard leg in which there is provided a stabilizer plate connected to the outboard leg, and positioned such that a substantial portion of the plate has a lower surface adapted to be located just in or skimming the surface of the water in the wake produced by said marine craft, and said plate comprising:

a substantially flat central portion with an attachment means to attach the central portion to an existing cavitation plate on the motor, said central portion being of a width similar to that of the existing cavitation plate and being adapted to capture water thrown up by the propeller;

two substantially flat, longitudinally disposed, upwardly sloping portions, one portion being disposed on either side of the central portion, said central portion and said upwardly sloping portions extending rearwardly from the outboard leg beyond the extent of the propeller approximately the length of one diameter of said propeller beyond the propeller, each of said upwardly sloping portions having an inner edge nearer the central portion and an outer edge, the angle of said upwardly sloping portions approximating the angle of the bottom of the marine craft and being adapted to skim the wake of the craft when running; and two peripheral portions, one for each upwardly sloping portion, attached to a respective outer edge of each of the upwardly sloping portions, the peripheral portions being between 0 degrees and 45 degrees below a plane parallel to a plane containing the central portion, and said peripheral portions being adapted to run in relatively less turbulent water away from the immediate vicinity of a propeller.

* * * * *